US006117253A

United States Patent [19]

Kim et al.

[11] Patent Number: 6,117,253

[45] Date of Patent: Sep. 12, 2000

[54] COLD ROLLED STEEL SHEET FOR SHADOW MASK MADE BY LOW-TEMPERATURE ANNEALING AND MANUFACTURING METHOD THEREFOR

[75] Inventors: Ki Soo Kim; Hyun Gyu Hwang; Eel Young Kim; Chin Kwan Chang; Oh Joon Kwon, all of Kyungsangbook-do, Rep. of Korea

[73] Assignee: Pohang Iron & Steel Co., Ltd., Rep. of Korea

[21] Appl. No.: 09/215,841

[22] Filed: Dec. 18, 1998

[30] Foreign Application Priority Data

Dec. 20, 1997 [KR] Rep. of Korea ..... 97-71421

[51] Int. Cl.[7] ..... C21D 8/00; C22C 38/18; C22C 38/06

[52] U.S. Cl. ..... 148/603; 148/651; 148/333

[58] Field of Search ..... 148/603, 651, 148/333; 420/104

[56] References Cited

U.S. PATENT DOCUMENTS 5,156,694 10/1992 Yamazaki et al. ..... 148/603

FOREIGN PATENT DOCUMENTS 9-049056 2/1997 Japan .

OTHER PUBLICATIONS

Usuki, Satoru et al., "Influence of Annealing Atmosphere on Mechanical Properties of Extra Low Carbon Aluminium–killed Steel used as Material of Shadow Mask," *Sheet Products & Proc.*, Jun. 1983, pp. 12–19.

*Primary Examiner*—Deborah Yee
*Attorney, Agent, or Firm*—Webb Ziesenheim Logsdon Orkin & Hanson, P.C.

[57] ABSTRACT

The present invention is related to the cold rolled steel sheet for making a shadow mask of a cathode ray tube of a color Braun tube for selecting colors and a manufacturing method therefor. Objects of the present invention are to enable production of a cold rolled steel sheet by one-step cold rolling and low-temperature annealing rather than by the conventional two-step cold rolling and decarburization annealing, and to provide a cold rolled steel sheet for a shadow mask and the manufacturing method therefor having better etchability and formability which are required for the material for a shadow mask than those of the conventional cold rolled steel sheets. The manufacturing method of the cold rolled steel sheet of the present invention is comprised of the steps of homogenizing the aluminum killed steel, which is composed in weight % of less than 0.002% of C, 0.20–0.45% of Mn, 0.015–0.020% of S, less than 0.02% of P, less than 0.01% of Si, 0.01–0.03% of Cr, 0.01–0.02% of Al, 0.0010–0.0020% of O, more than 100 of Mn %/C %, in the range of 5–20 of Al %/O%, in the range of 10–30 of Mn %/S %, a balance of Fe, and other unavoidable impurities, in the temperature range of 1,100–1,250° C.; hot rolling in the finish rolling temperature range of 900–950° C.; coiling in the temperature range of 720–750° C.; cold rolling in the reduction ratio range of 75–85%; and low-temperature annealing in the non-recrystallization temperature range of 540–640° C.

3 Claims, 9 Drawing Sheets

(a)

(b)

(a)

(b)

COLD ROLLED STEEL SHEET FOR SHADOW MASK MADE BY LOW-TEMPERATURE ANNEALING AND MANUFACTURING METHOD THEREFOR

BACKGROUND OF THE INVENTION

1. Field of the Invention

The present invention is related to the cold rolled steel sheet for making a shadow mask of a cathode ray tube of a color Braun tube for selecting colors and a manufacturing method therefor. In more detail, the present invention is related to a cold rolled steel sheet for making a shadow mask and a manufacturing method therefor, in which the cold rolled steel sheet is manufactured by one-step cold rolling and low-temperature annealing by properly controlling the chemical composition and manufacturing process, rather than by two-step cold rolling and open coil annealing so that the cold rolled steel sheet has the equivalent etchability and formability as those of the conventional products which are required for the material for a shadow mask while reducing the production steps and manufacturing cost significantly.

2. Description of the Prior Art

Conventionally, the cold rolled steel sheet for a shadow mask has been manufactured by going through steel manufacture and hot rolling which are the usual manufacturing process of the steel sheet, open coil annealing after the first cold rolling as shown in FIG. 1(*a*) in order to remove solute carbons which have negative effects on formability and magnetic properties, and the second cold rolling process. Therefore, besides highly expensive open coil annealing (OCA) facilities and usual cold rolling facilities, separate second rolling facilities (DCR-mill, double cold reduction) for the second cold rolling have been required for the manufacture of the cold rolled steel sheet for a shadow mask. For this reason, the manufacturing cost for the cold rolled steel sheet for a shadow mask is five times higher than that of the cold rolled steel sheet which is produced according to the conventional processes. However, contrary to these processes, in reality, it does not seem that the manufacturing method according to the one-step rolling, which does not require open coil annealing and the second rolling, and other conventional annealing facilities have been established.

A shadow mask (10) is, as shown in FIG. 2, a part attached to inside of a Braun tube (1) which is vacuum and is composed of very minute holes (11). Minute holes are parts that reproduce the final color by properly selecting electron beams, which are responsible for red, blue, and green colors coming from an electron gun (2).

Therefore, requirements for a cold rolled steel sheet for a shadow mask would be the etchability of holes, magnetic property, press formability, black oxide film adherence, maintenance of degree of vacuum, and others. In order to satisfy such composite requirements, a cold rolled steel sheet for a shadow mask has to have cleanness without impurities, no coarse precipitates, strictly controlled thickness, and superior shape.

Among the processes shown in FIG. 1(*b*), hundreds of thousands of minute holes having a diameter of about 0.2 mm are made during the etching process according to the photo-etching technique by using the ferric chloride solution. At this time, the shapes of etched holes have to be perfect, and homogeneity has to be secured. If the shapes of holes are not homogeneous, blotting of colors occurs in the color Braun tube. Therefore, having superior etchability is the basic requirement for a cold rolled steel sheet for a shadow mask.

The shadow mask which has been etched goes through the second annealing in order to facilitate the forming process which is the next process. Proper ductility is secured for the material through the annealing process and very superior formability is required in order to have a necessary bending radius suitable for a Braun tube. It is because forming characteristics for a sheet having minute holes appear to be different from those for a sheet having no minute holes. If the deformation around holes is not homogeneous, the shapes of holes may be changed during the forming process, resulting in the blotting of colors. Carbons in the steel assume a very important role in order to secure a superior formability.

The most important element determining strength of the ordinary steel sheet is carbon. Steels are divided into the high carbon steel, medium carbon steel, low carbon steel, and extremely low carbon steel according to the amount of carbon content. Low carbon steel and extremely low carbon steel are generally used for a cold rolled steel sheet for a shadow mask. Carbons in the steel take the form of a $Fe_3C$ compound, i.e., a carbide, or a solute carbon as an atom. Carbides are precipitated along the grain boundary, and solute carbons can not be observed even through a microscope since they locate at the interstitial sites among Fe atoms as shown in FIG. 3. Also, carbon atoms are very small compared to Fe atoms, and therefore, they cause the strain aging phenomenon by interacting with dislocations which are the plastic deformation mechanism of steel plates. In other words, deformation of a steel sheet by the external force is due to the movement of dislocations in the steel sheet, which is hindered by solute carbons. Accordingly, dislocations move as shown in FIG. 4(*b*) and the movement is not smooth as shown in FIG. 4(*a*) due to the hindrance by solute carbons, and this movement causes the yield point elongation during tensile tests as shown in FIG. 5.

If such yield point elongation still exists after the second annealing in a cold rolled steel sheet for a shadow mask, the steel sheet of high quality may not be obtained since the hardness of the material is increased, shape fixability is lowered, and stretcher strain, in which the shapes of holes are changed to be non-homogeneous according to the yield point elongation, occurs. Therefore, reducing the amount of solute carbons in the steel during the conventional open coil annealing is essential for decreasing the hardness and eliminating the yield point elongation in the manufacture of a cold rolled steel sheet for a shadow mask. The titanium-added extremely low carbon steel does not show the yield point elongation because all the carbon is precipitated as TiC. However, it has been definitely disadvantageous in that its manufacturing process is somewhat complicated, there are problems of clogging of nozzle during continuous casting processes and other problems, and particularly, the magnetic property is extremely lowered due to fine precipitates formed. Further, the shadow mask formed as desired is subject to the blackening processing. This is to prevent oxidation or blue-coloring of the shadow mask as well as to absorb or discharge heat in the Braun tube effectively.

In the meantime, inside of a Braun tube has to be shielded from the external magnetic field in order to allow electron beams to progress correctly to the desired direction. For this reason, a shadow mask steel sheet has to have superior magnetic property, and require for the coercive force of less than 1.3 Oe generally. Also, maintenance of the degree of vacuum inside of a Braun tube has to be secured so that no gas is discharged from inside of the steel sheet as the time goes by. It is because the life of the electron gun is shortened, and it can not perform its function as a Braun tube if the degree of vacuum is lowered.

The present invention is, therefore, to solve the problem of very high manufacturing cost of a cold rolled steel sheet for a shadow mask manufactured by the current two-step cold rolling and open coil annealing processes and to manufacture a cold rolled steel sheet of a shadow mask by employing the one-step cold rolling and low-temperature annealing processes while satisfying the above-described requirements through metallurgical researches and experiments and based on the results of such researches and experiments.

SUMMARY OF THE INVENTION

It is therefore an object of the present invention to provide a cold rolled steel sheet for a shadow mask having superior etchability, no problem of hardness in forming after the second annealing, and superior magnetic property, as well as the manufacturing method therefor, by suggesting the chemical composition and establishing the manufacturing method of an alloy in which the hardness of the material is lowered by properly controlling the amounts and ratios of Mn and C to be added, as well as the amounts and ratios of Al and O to be added with the extremely low carbon aluminum killed steel as the basic component, and by controlling each processing variable at the hot rolling, cold rolling, and annealing steps.

BRIEF DESCRIPTION OF THE DRAWINGS

The foregoing and other objects, aspects and advantages will be better understood from the following detailed description of the invention with reference to the drawings, in which.

DETAILED DESCRIPTION OF A PREFERRED EMBODIMENT OF THE INVENTION

Figure 1:
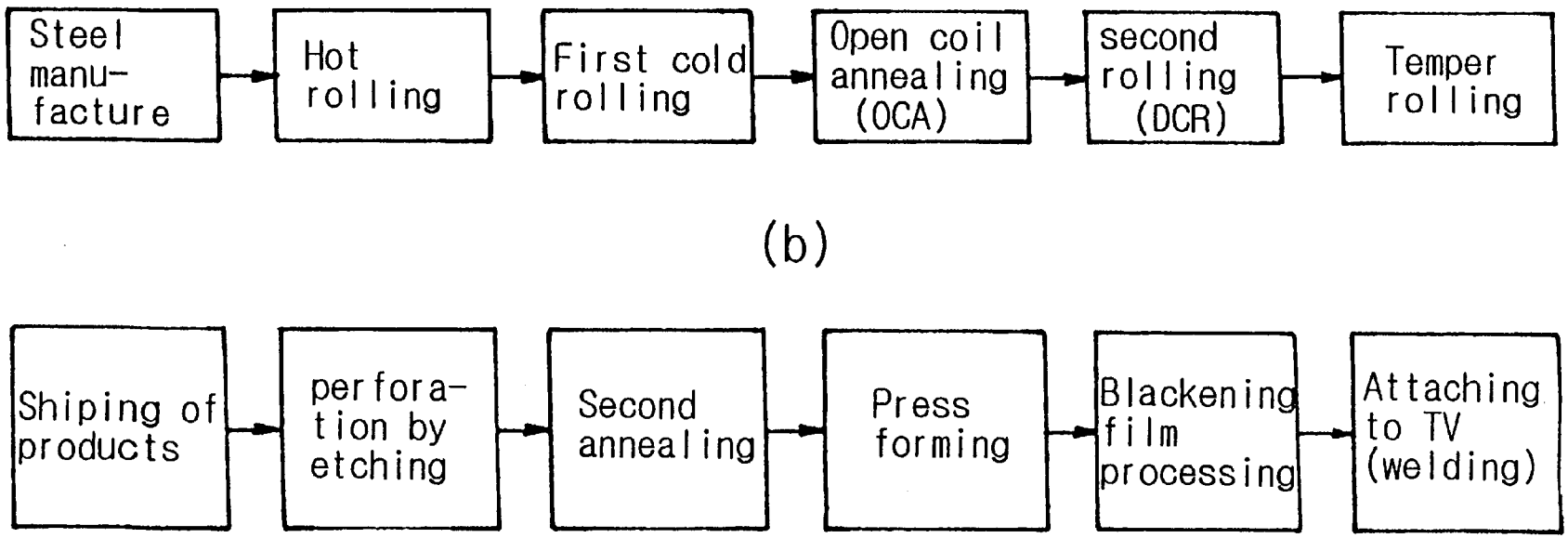
FIG. 1 PRIOR ART
FIG. 1 is a manufacturing process diagram of a cold rolled steel sheet for a shadow mask.
Figure 2:
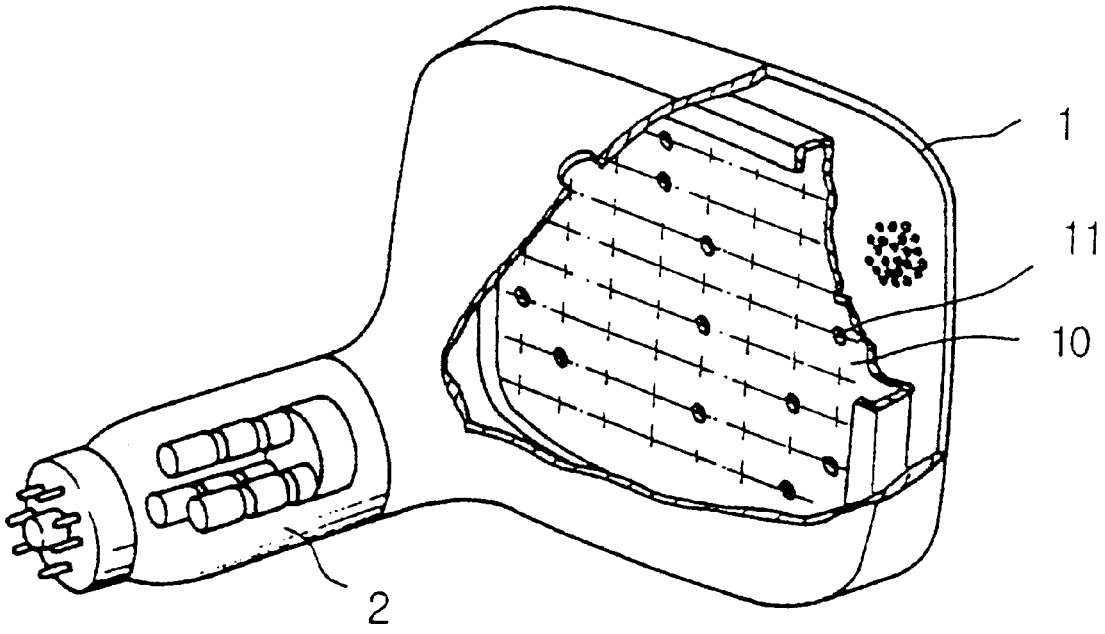
FIG. 2 is an outlined diagram of a Braun tube.
Figure 3:
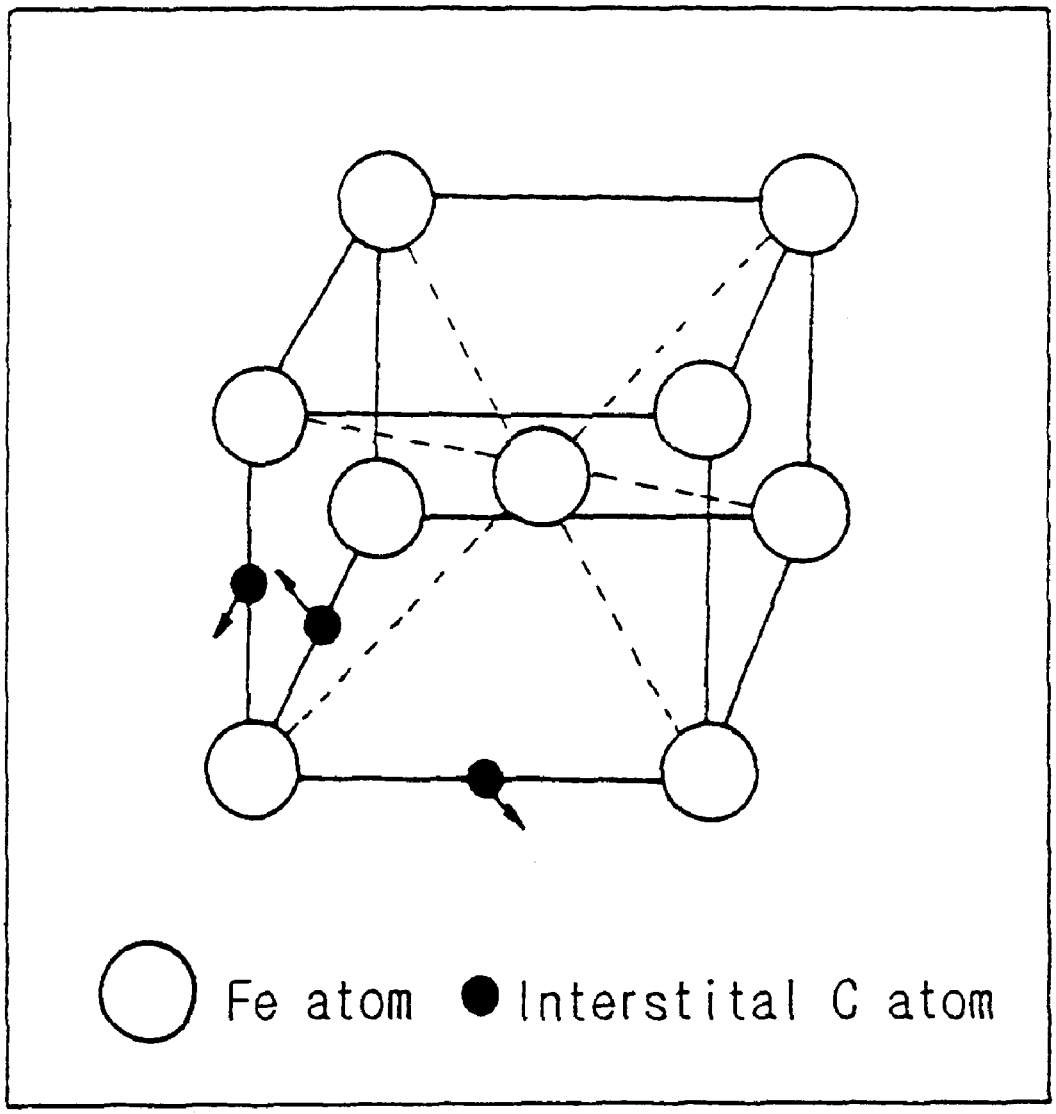
FIG. 3 is a lattice structural diagram showing position of solute carbons in the steel.
Figure 4:
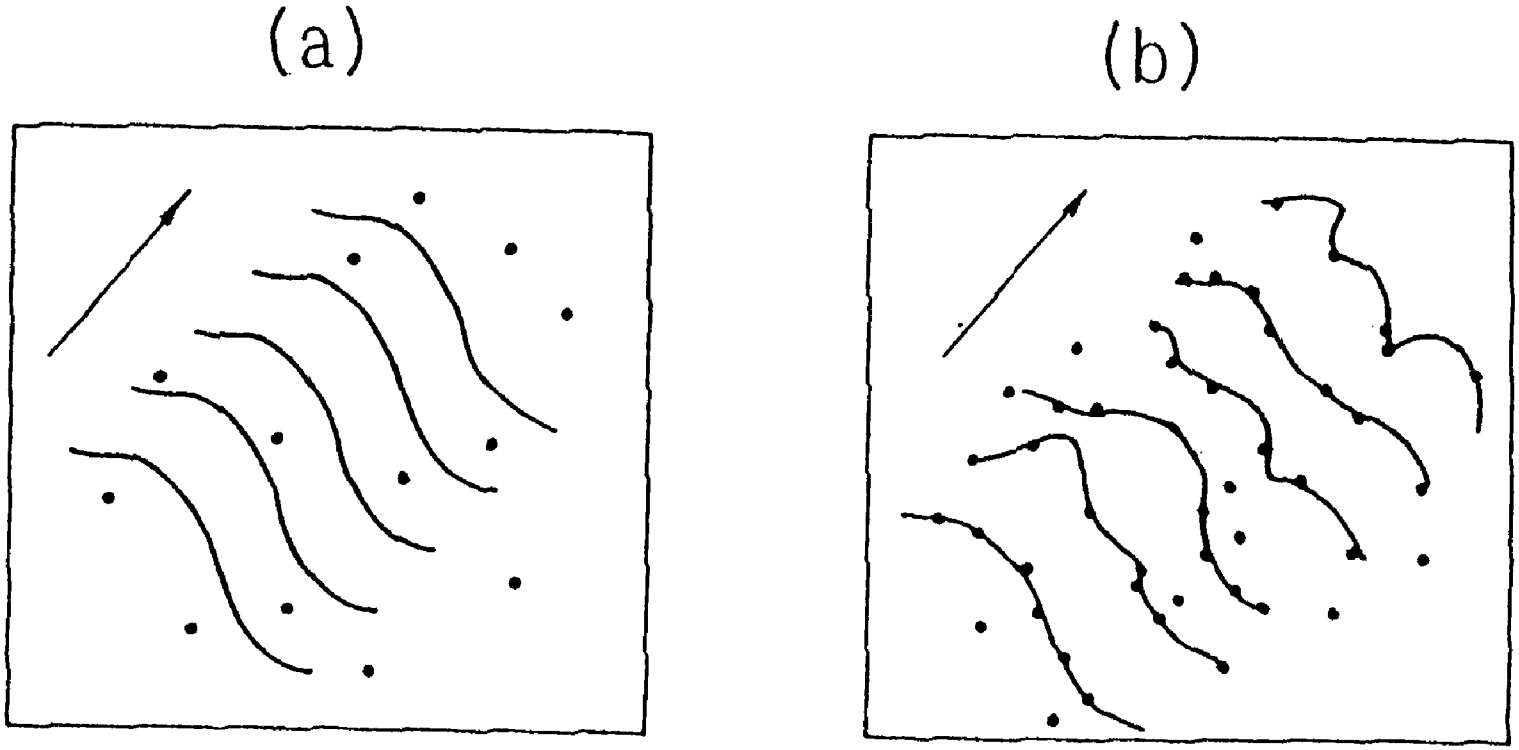
FIGS. 4(*a*) and 4(*b*) are diagrams showing the mechanism of generating yield point elongation by dislocations and solute carbons.
Figure 5:
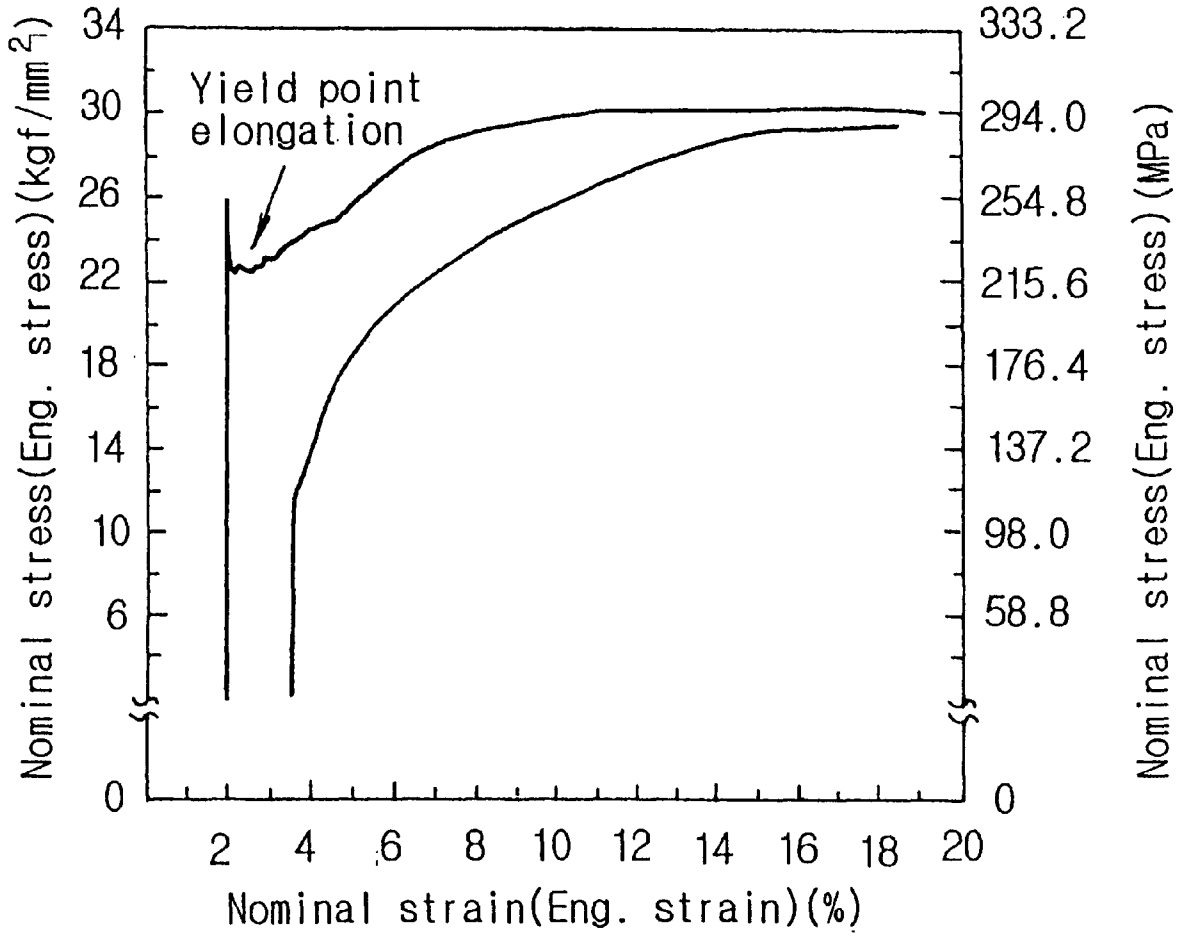
FIG. 5 is a graph showing yield point elongation and tensile test curve.

The cold rolled steel sheet for making a shadow mask of the present invention is composed in weight % of less than 0.002% of C, 0.20–0.45% of Mn, 0.015–0.020% of S, less than 0.02% of P, less than 0.01% of Si, 0.01–0.03% of Cr, 0.01–0.02% of Al, 0.0010–0.0020% of 0, more than 100 of Mn %/C %, in the range of 5–10 of Al %/O %, in the range of 10–30 of Mn %/S %, a balance of Fe, and other unavoidable impurities.

Further, the manufacturing method of the cold rolled steel sheet of the present invention is comprised of the steps of homogenizing the aluminum killed steel, which is composed in weight % of less than 0.002% of C, 0.20–0.45% of Mn, 0.015–0.020% of S, less than 0.02% of P, less than 0.01% of Si, 0.01–0.03% of Cr, 0.01–0.02% of Al, 0.0010–0.0020% of 0, more than 100 of Mn %/C %, in the range of 5–20 of Al %/O %, in the range of 10–30 of Mn %/S %, a balance of Fe, and other unavoidable impurities, in the temperature range of 1,100–1,250° C.; hot rolling in the finish rolling temperature range of 900–950° C.; coiling in the temperature range of 720–750° C.; cold rolling in the reduction ratio range of 75–85%; and low-temperature annealing in the non- recrystallization temperature range of 540–640° C.

If the C content is less than 0.002%, precipitation of carbides becomes difficult and it is possible to obtain a low yield strength. Whereas, if the C content is more than that, yield point elongation occurs seriously and the strength is increased subsequently thus lowering formability. Therefore, it is desirable to limit the C content to less than 0.002%. It is desirable to reduce the C content as much as possible, however, the C content is set at less than 0.002% which is not unreasonable for its industrial production since setting it below 0.002% is not advantageous in view of the manufacturing cost.

Generally, more than 0.05% of Mn is added in order to prevent red shortness due to S contained in the steel during its manufacturing process inevitably, and S is fixed by forming sulfur compounds such as MnS, etc. It is desirable in the present invention to limit the amount of Mn to be added to the range of 0.20–0.45%. That is, if more than 0.45% of Mn is added, the hardness of the steel is increased leading to inferior formability. The reason for adding more than 0.20% Mn is to reduce the solute carbons as well as to prevent the red shortness. As mentioned above, when the carbon content is less than 0.0020%, carbides precipitation is difficult. However, the addition of Mn promotes the carbide precipitation providing the heterogeneous nucleation sites for carbides precipitates.

In the meantime, as to the compositional range of Mn in the present invention, it is preferred to have the ratio(Mn/C) of Mn to C more than 100 so as to produce fine $\epsilon$-carbides since it is difficult to precipitate carbons at C content of less than 0.002%. That is, the solute carbon content is controlled to be minimized. Further, all harmful S are to be formed into MnS with a sufficient amount of Mn so that the ratio(Mn/S) of Mn to S is 10–30. Since S is known to be a harmful element for the steel, it is desirable to remove S if possible, but it is difficult to completely remove S industrially. And as removal of S is costly, the S content is set to the 0.05–0.020% which is reasonable without greatly changing facilities for mass-production.

Whereas, Al is added more than 0.01% for the deoxidation of molten steel. However, the formability and magnetic properties are deteriorated with the increase of acid soluble Al contents. Therefore, the maximum Al content is determined as 0.02%. Also, O content is limited to 0.0010–0.0020% range as O decreases magnetic properties significantly. Here, it is preferred to have 5–10 range as the ratio(Al/O) of the Al content to the O content because the volume fraction of $Al_2O_3$ is too high, resulting in the deterioration of magnetic properties.

Further, P and Si are elements which are responsible for solid solution hardening, and therefore, their contents are limited to less than 0.02% and less than 0.01%, respectively, in order to control the hardness by the amount of carbons, which is aimed in the present invention.

Still further, it is desirable to limit the Cr content to 0.01–0.03% in order to secure black oxide film adherence.

If the Cr content is less than that, black oxide film adherence is lowered, while if it is more, the magnetic property is affected negatively.

It is essential in the present invention to manufacture a cold rolled steel sheet for a shadow mask by manufacturing the aluminum killed steel to satisfy the above-described compositional ranges, after which by hot rolling and cold rolling to satisfy the following conditions for the reasons that:

The steel smelted with the above-described composition is homogenized in the temperature range of 1,100–1,250° C., which is the temperature for forming sulfur compounds and suitable for hot rolling.

After the homogenization heat treatment, the steel is subject to hot rolling, where hot rolling is finished in the temperature range of 900–950° C., above the $Ar_3$ temperature. And then high-temperature coiling is carried out in the temperature range 720–750° C. and coarse carbides are formed.

In the meantime, it is preferred to perform the coiled steel sheet cold rolled with the reduction ratio range of 75–85%. If the reduction ratio becomes lower than 75%, it takes a longer time in the hot rolling because the thickness of the hot rolled steel sheet should become thinner, with the result that there occurs problem such as a larger mechanical property deviation along the length direction of the hot rolled steel sheet. In other words, the temperature of the rear end of the hot rolled steel sheet is greatly lowered due to longer stand-by time for hot finish rolling, and it is not possible to obtain identical characteristics with those of the front end of the hot rolled steel sheet. Whereas, if the reduction ratio is more than 85%, the thickness of the hot rolled steel sheet has to be thick contrarily, and therefore, there occurs a difference in grain size after hot rolling leading to greater deviation in the material quality in the thicknesswise direction of the coil.

The steel sheet which has been cold rolled in the reduction ratio range as described in the above then goes through low-temperature annealing in the temperature range of 540–640° C. without going through the usual open coil annealing process. The low-temperature annealing has an entirely different concept from conventional processes during which annealing is performed in the temperature range of 640–800° C. This annealing temperature is the temperature at which extinguishment of dislocations occurs vigorously, and corresponds to the recovery step prior to recrystallization. Therefore, this annealing process is essential for securing etchability which is required by a cold rolled steel sheet for a shadow mask.

In the temper rolling process which is performed after the non-recrystallization annealing process, non-homogeneous recrystallization may occur due to increase in the temperature during the second annealing since a great deal of dislocations are produced in the steel. Accordingly, it is desirable to limit the temper rolling reduction ratio to less than 0.7% range, if necessary, in order to secure the final shape although it is advantageous not to perform temper rolling in the manufacture of a cold rolled steel sheet for a shadow mask, if at all possible.

Now, a preferred embodiment of the present invention is described in more details as follows:

Steel slabs having the compositions shown in Table 1 below were kept in a heating furnace of 1,200° C. for 1.2 hours, and then were hot rolled. The hot rolling finish temperature was 920° C., and the coiling temperature was 725° C. The hot rolled steel sheet which had been subject to hot rolling and coiling was cold rolled at the cold rolling reduction ratio of 84% and low-temperature annealed at the temperature of 570° C. A cold rolled steel sheet was then manufactured by performing temper rolling of about 0.7% for the cold rolled steel sheet which had been annealed at a low temperature.

Figure 6:
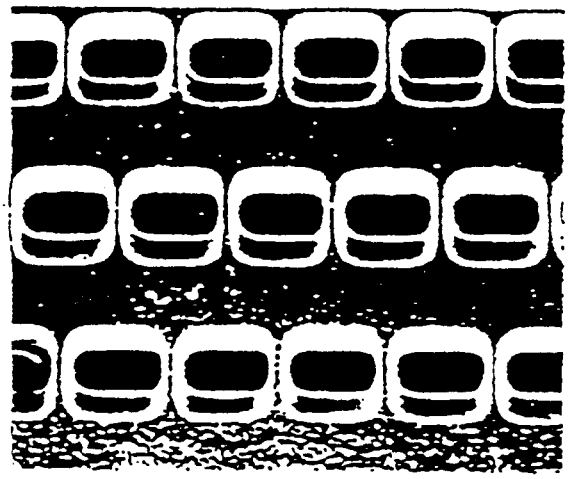
FIGS. 6(*a*) and 6(*b*) are photographs showing good and bad holes of a shadow mask.
Figure 6:
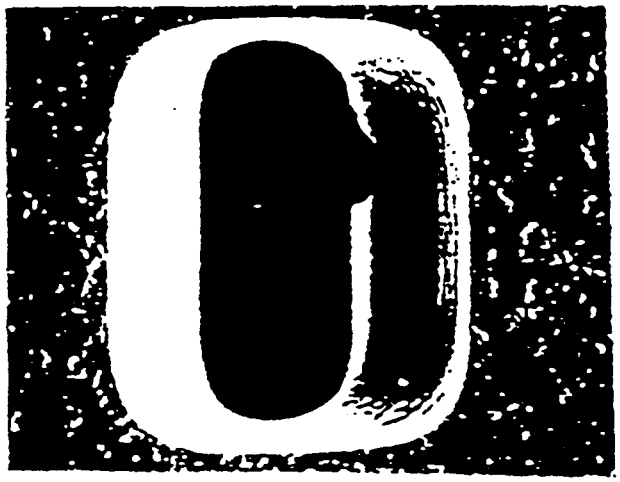

The results of performing photo-etching and forming of the cold roller steel sheet for the shadow mask manufactured as described in the above shown in Table 1, and the shapes of superior holes (inventive and inferior holes (comparative steel 4) are shown in FIG. 6.

TABLE 1

| Steel | | Alloy compositions (wt %) | | | | | | | | | | | |
|---|---|---|---|---|---|---|---|---|---|---|---|---|---|
| | | C | Mn | S | P | Si | Al | O | Cr | Nb | Mn/C | Al/O | Mn/S |
| Comparative steel | 1 | 0.0023 | 0.13 | 0.012 | 0.020 | 0.01 | 0.045 | 0.0021 | 0.03 | — | 56.5 | 21.4 | 10.8 |
| | 2 | 0.0022 | 0.18 | 0.012 | 0.012 | 0.02 | 0.023 | 0.0017 | 0.02 | 0.01 | 81.8 | 13.5 | 15 |
| | 3 | 0.0026 | 0.15 | 0.008 | 0.013 | 0.006 | 0.034 | 0.0015 | 0.03 | 0.006 | 57.69 | 22.6 | 18.7 |
| | 4 | 0.0024 | 0.18 | 0.014 | 0.010 | 0.01 | 0.038 | 0.0014 | 0.015 | — | 75 | 27.1 | 12.8 |
| Inventive Steel | 1 | 0.0020 | 0.25 | 0.010 | 0.010 | 0.008 | 0.012 | 0.0015 | 0.03 | — | 125 | 8 | 25 |
| | 2 | 0.0018 | 0.27 | 0.009 | 0.009 | 0.06 | 0.012 | 0.0015 | 0.028 | — | 150 | 8 | 16.8 |

TABLE 2

| Steel | | First annealing Annealing temperature (° C.) | Results of etching | Results of forming | Magnetic property Coercive force (Oe) |
|---|---|---|---|---|---|
| Comparative steel | 1 | 540 | Δ | Δ | 1.7 |
| | 2 | 650 | ○ | X | 2.1 |
| | 3 | 550 | ○ | Δ | 1.8 |
| | 4 | 650 | X | X | 1.3 |
| Inventive steel | 1 | 540 | ○ | ○ | 1.3 |
| | 2 | 580 | ○ | ○ | 1.2 |

* Results of etching and forming: ○ Good, Δ Partially good, X No good
* Conditions for hot rolling: Homogenization process 1,200° C.; Hot rolling finish temperature 920° C.

Inferior etching of holes appeared if there were too many precipitates or the annealing temperature was too high. As shown in Tables 1 and 2 above, in case of the comparative steel 1, Al was excessively contained, the ratio(Al/O) of Al content to O content was reached to 22, and inferior etching of holes due to a great deal of Al oxide type inclusions occurred partially. Moreover, the comparative steel 1 had the coercive force of 1.7 Oe due to the inclusions, and could not be used for a cold rolled steel sheet for a shadow mask requiring the coercive force of less than 1.3 Oe. It was also seen that low-temperature annealing was essential for securing etchability from the case of the comparative steel 4 which was obtained by high-temperature annealing at the temperature of 650° C.

As a result, the comparative steels 2 and 3 and inventive steels 1 and 2 showed good etchability. However, some steels were no good (comparative steels 2 and 3) in the press forming process after the second annealing although their etchability had been secured. It was because, in case of the comparative steel 2, sufficient volume fraction of recrystallized grains was not secured during the second annealing as the recrystallization temperature had been increased due to excessively added Nb. The comparative steel 2 was not proper for a steel sheet for a shadow mask either due to its too high coercive force, 2.1 Oe resulted from fine grain size. In the meantime, the reason for good etchability for the comparative steel 2 was because it was a steel having a high recrystallization temperature according to the Nb content although its first annealing was performed under the high-temperature annealing condition of 650° C.

The comparative steel 3 showed a little better characteristics since its Nb content was lower than that of the comparative steel 2, however, its industrial use was limited because of its still high coercive force of 1.8 Oe and partial safe forming of parts.

Figure 7:
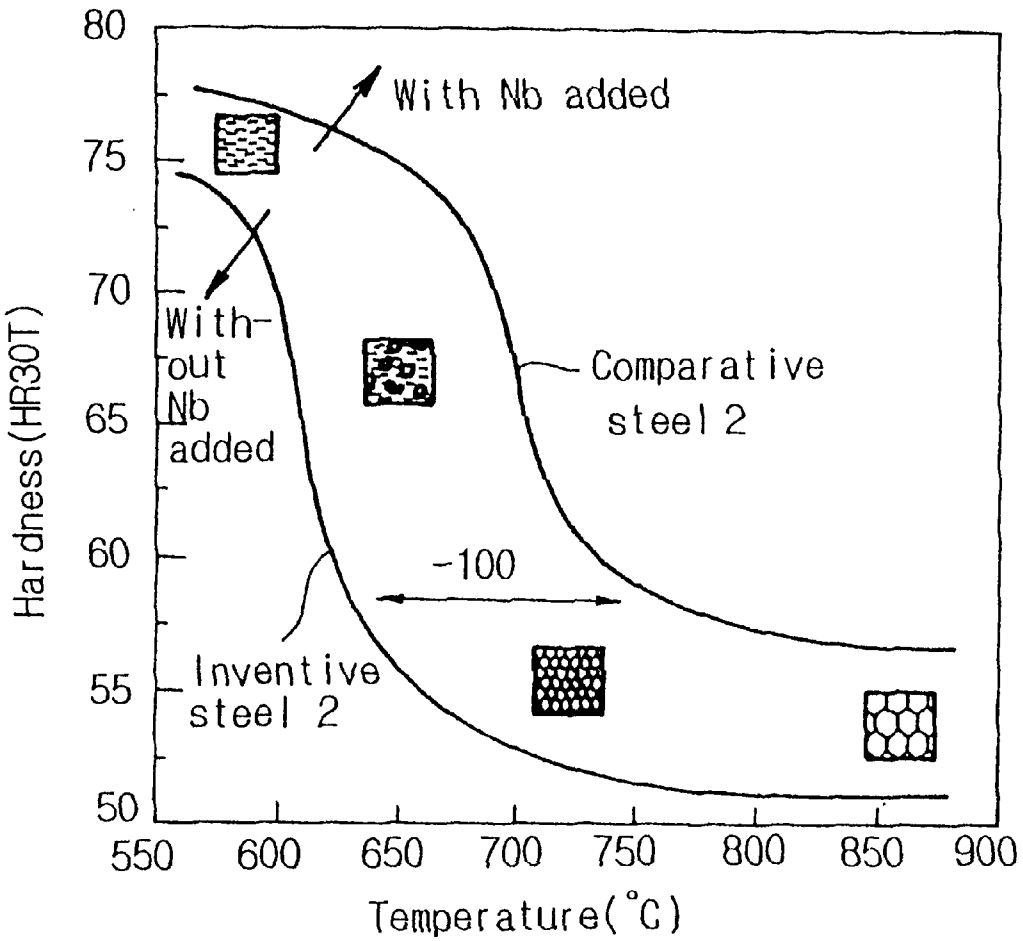
FIG. 7 is a graph showing the change in hardness according to the temperature.

In the meantime, the change in hardness according to the annealing temperature of the comparative steel 2 and inventive steel 2 is shown in FIG. 7, showing that the recrystallization temperature of inventive steel 2 is much lower than that of comparative steel 2 due to the Nb addition. As seen in this figure, the comparative steels 2 and 3 showed much higher hardness than that of inventive steel 1 and 2 due to finer grain size, although the amount of Nb content was low, less than 1 of a ratio(Nb/C), which means insufficient scavenging of solute carbon.

Figure 8:
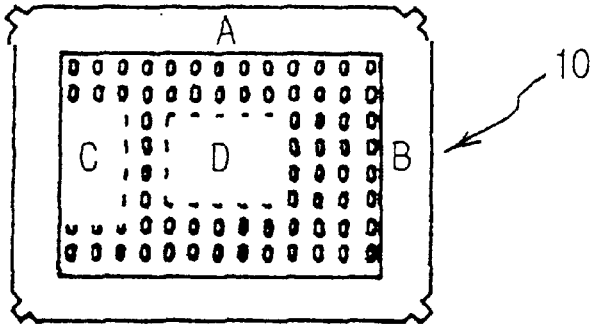
FIGS. 8(*a*) and 8(*b*) show graphs showing tensile test curves for each part of the shadow mask after the second annealing.
Figure 8:
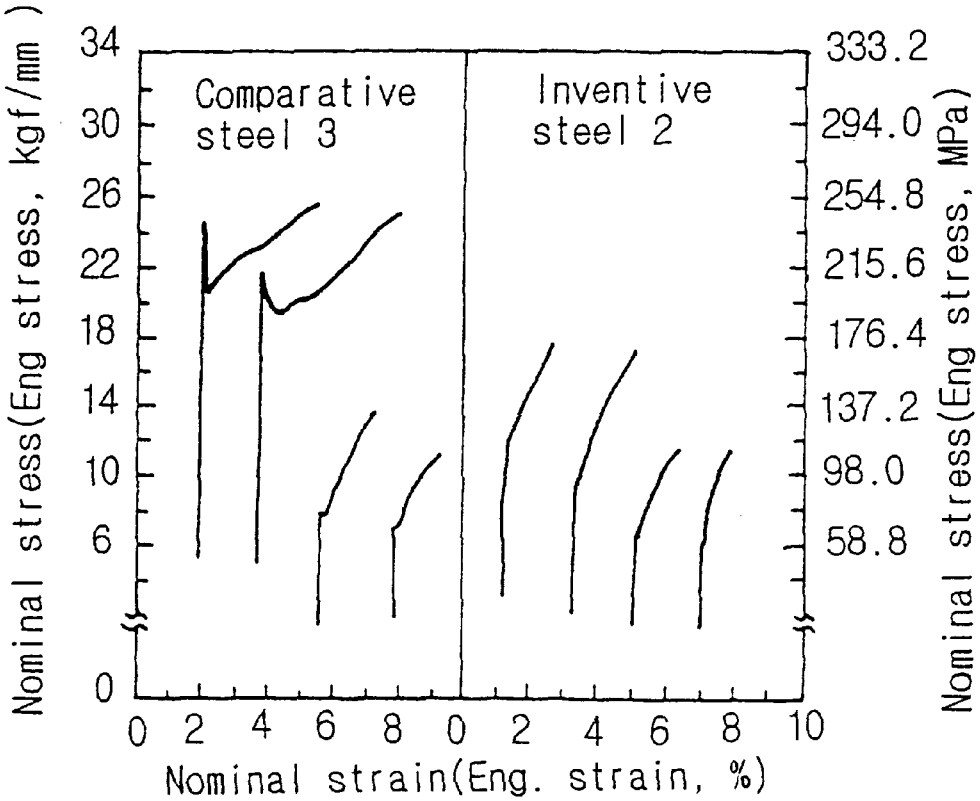
Figure 9:
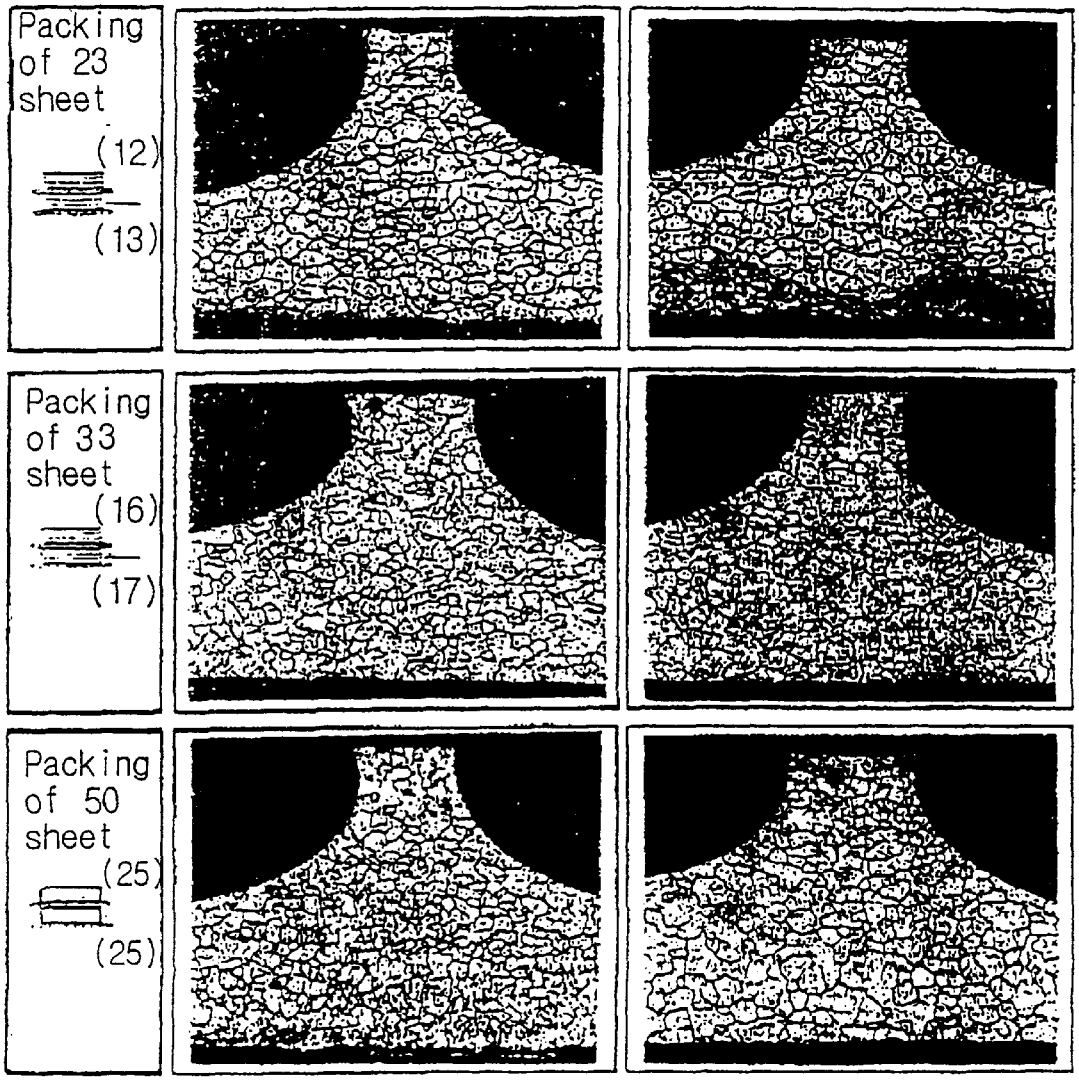
FIG. 9 shows the optical structure for each part of the shadow mask after the second annealing.

FIGS. 8 and 9 show tensile test curves and the microstructure of each part, respectively, with respect to each part of the shadow mask after the second annealing of the comparative steel 3 and inventive steel 2. It was seen that the inventive steel 2 showed lower yield strength and yield point elongation, better shape fixability during forming, and more advantageous magnetic property as grain size was larger.

As described in the above, the present invention is effective in the manufacture of a cold rolled steel sheet in which etchability of holes of a shadow mask is secured, superior workability is obtained by minimizing the increase in yield strength after the second annealing, and the excellent magnetic property is secured by coarse grain structure, properly controlling and adding C, Mn, Al, and O, and further properly setting the hot rolling coiling conditions, cold rolling, annealing temperature, and temper rolling reduction ratio.

What is claimed is:

1. A cold rolled steel sheet for making a shadow mask comprising in weight % of less than 0.002% of C, 0.20–0.45% of Mn, 0.015%–0.020% of S, less than 0.02% of P, less than 0.01% of Si, 0.01%–0.03% of Cr, 0.01–0.02% of Al, and 0.0010–0.0020% of O to satisfy more than 100 of Mn %/C %, in the range of 5–20 of Al %/O %, and in the range of 10–30 of Mn %/S %, and still comprising a balance of Fe and other unavoidable impurities.

2. A method of manufacturing a cold rolled steel sheet for a shadow mask comprising the steps of:

homogenizing an aluminum killed steel in the temperature range of 1,100–1,250° C., said aluminum killed steel having a composition in weight % of less than 0.002% of C, 0.20–0.45% of Mn, 0.015–0.020% of S, less than 0.02% of P, less than 0.01% of Si, 0.01%–0.03% of Cr, 0.01–0.02% of Al, and 0.0010–0.0020% of O to satisfy more than 100 of Mn %/C %, in the range of 5–20 of Al %/O %, and in the range of 10–30 of Mn %/S %, and still comprising a balance of Fe and other unavoidable impurities;

hot rolling in the finish rolling temperature range of 900–950° C.;

coiling in the temperature range of 720–750° C.;

cold rolling in the reduction ratio range of 75–85%; and low-temperature annealing in the non-recrystallization temperature range of 540–640° C.

3. The method of manufacturing a cold rolled steel sheet for a shadow mask of claim 2, wherein temper rolling is performed in the temper rolling reduction ratio range of less than 0.7% after said low-temperature annealing.

* * * * *

UNITED STATES PATENT AND TRADEMARK OFFICE

CERTIFICATE OF CORRECTION

PATENT NO. : 6,117,253

DATED : September 12, 2000

INVENTOR(S) : Ki Soo Kim et al.

It is certified that error appears in the above-identified patent and that said Letters Patent is hereby corrected as shown below:

Column 6 Line 23 after "above" insert --are--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*